US008978636B2

(12) United States Patent
Bednar et al.

(10) Patent No.: US 8,978,636 B2
(45) Date of Patent: Mar. 17, 2015

(54) BOW DAMPENER

(71) Applicant: Hunter's Manufacturing Company, Inc., Suffield, OH (US)

(72) Inventors: Richard L. Bednar, Munroe Falls, OH (US); Jacob A. Hout, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 80 days.

(21) Appl. No.: 13/718,058

(22) Filed: Dec. 18, 2012

(65) Prior Publication Data

US 2013/0174825 A1 Jul. 11, 2013

Related U.S. Application Data

(60) Provisional application No. 61/584,513, filed on Jan. 9, 2012.

(51) Int. Cl.

| | |
|---|---|
| ***F41B 5/20*** | (2006.01) |
| ***F41B 5/12*** | (2006.01) |
| ***F41B 5/14*** | (2006.01) |

(52) U.S. Cl.

CPC ..... *F41B 5/1426* (2013.01); *F41B 5/1407* (2013.01)

USPC ..... 124/89; 124/25

(58) Field of Classification Search

USPC ..... 124/25, 25.6, 86, 88, 89

See application file for complete search history.

(56) References Cited

U.S. PATENT DOCUMENTS

| | | | | |
|---|---|---|---|---|
| 5,992,403 | A * | 11/1999 | Slates | 124/89 |
| 7,721,724 | B2 * | 5/2010 | Goade | 124/89 |
| 7,753,044 | B2 * | 7/2010 | Goade | 124/89 |
| 8,276,576 | B1 | 10/2012 | Kuhn | |
| 8,408,195 | B2 | 4/2013 | McPherson | |
| 2010/0170488 | A1 * | 7/2010 | Rasor et al. | 124/25 |

OTHER PUBLICATIONS

StrykeForce Crossbow Owner's Manuel, 2010, BowTech.

Crossbow Test: StrykeForce by BowTech, ArrowTrade, vol. 13, No. 5, p. 112-118, Sep. 2009.

Crossbow Armcross Leopro, post on Crossbow Nation website, Jul. 12, 2010.

Darton Serpent Crossbow, post on Crossbow Nation website, Dec. 7, 2010.

Parker Tornado String Suppressor, post on New Jersey Hunter website, Mar. 6, 2010.

Parker Tornado Cable Stops, post on Crossbow Nation website, Jan. 24, 2010.

* cited by examiner

*Primary Examiner* — John Ricci

(74) *Attorney, Agent, or Firm* — Emerson Thomson Bennett

(57) ABSTRACT

One or more techniques and/or systems are disclosed for a bow dampener that may be devised to mitigate kinetic energy from a bow string. The bow dampener can comprise a frame element that may be configured to support a string dampening element. The string dampening element may be configured to engage the bowstring at or near an end of an arrow shooting operation. The frame element can comprise a barrel mount that is configured to selectively engage a side of a crossbow barrel, such as on one or more sides of the crossbow barrel.

18 Claims, 14 Drawing Sheets

BOW DAMPENER

CROSS-REFERENCE TO RELATED APPLICATIONS

This application claims the benefit of U.S. Provisional Application No. 61/584,513, filed Jan. 9, 2012. All of the subject matter disclosed by U.S. Provisional Application No. 61/584,513 is hereby incorporated by reference into this application.

BACKGROUND

Bows and crossbows are used to shoot arrows by movement of a bow string releasing energy stored in the bow's limbs. The bow string may still comprise substantial kinetic energy after an arrow has been shot or near the end of an arrow shooting operation.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Accordingly, among other things, one or more techniques and systems are disclosed for a bow dampener, which may be devised to mitigate kinetic energy from a bow string, for example, at or near the end of an arrow shooting operation.

In one implementation, the bow dampener can comprise a frame element, which can be configured to support a string dampening element. Further, the frame element can comprise a barrel mount, which may be configured to selectively engage a side of a crossbow barrel.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1A:
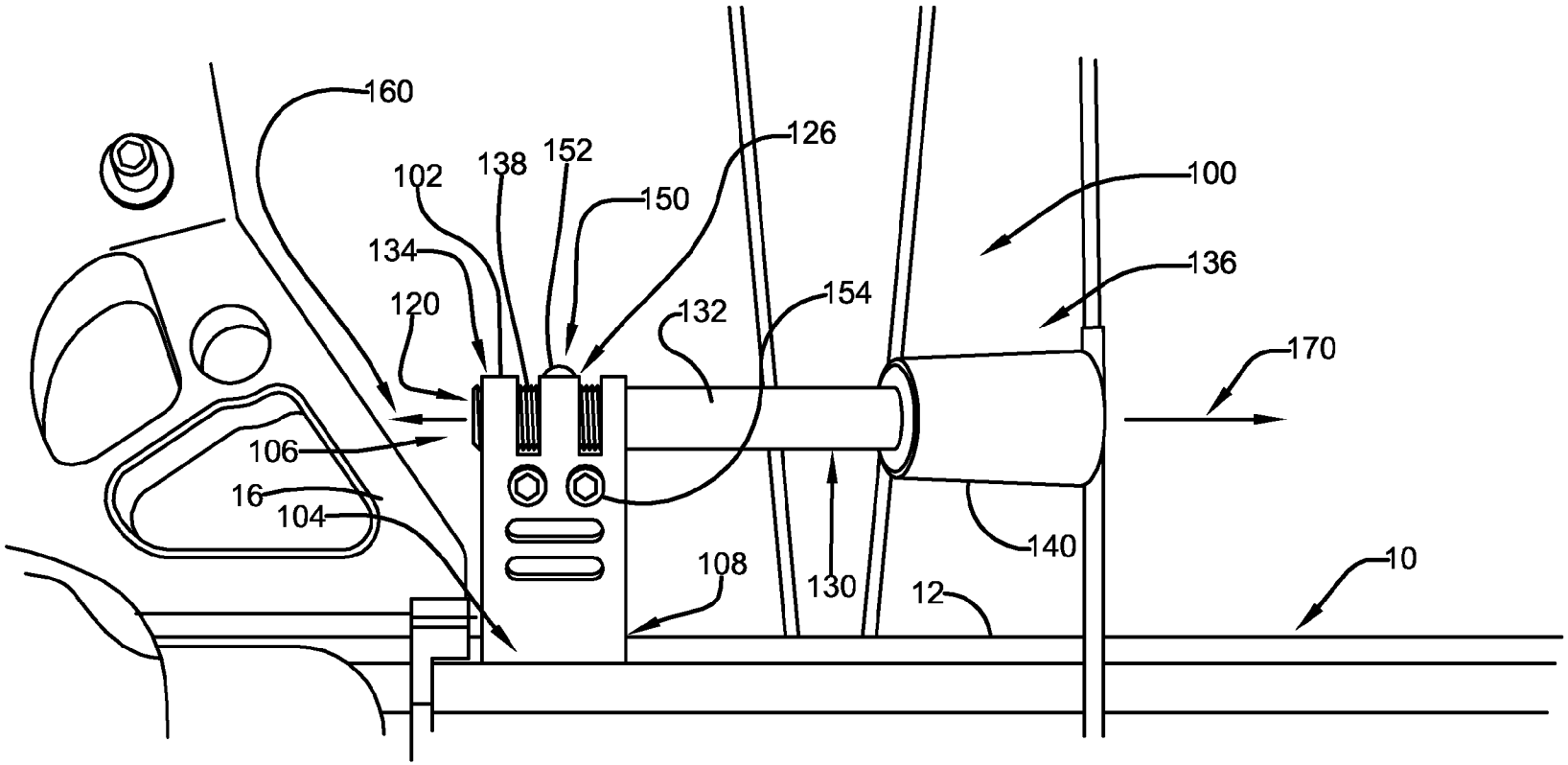
FIG. 1A is a component diagram illustrating a top view of an example implementation of a bow dampener on a crossbow.

The claimed subject matter is now described with reference to the drawings, FIGS. 1-13, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Figure 1B:
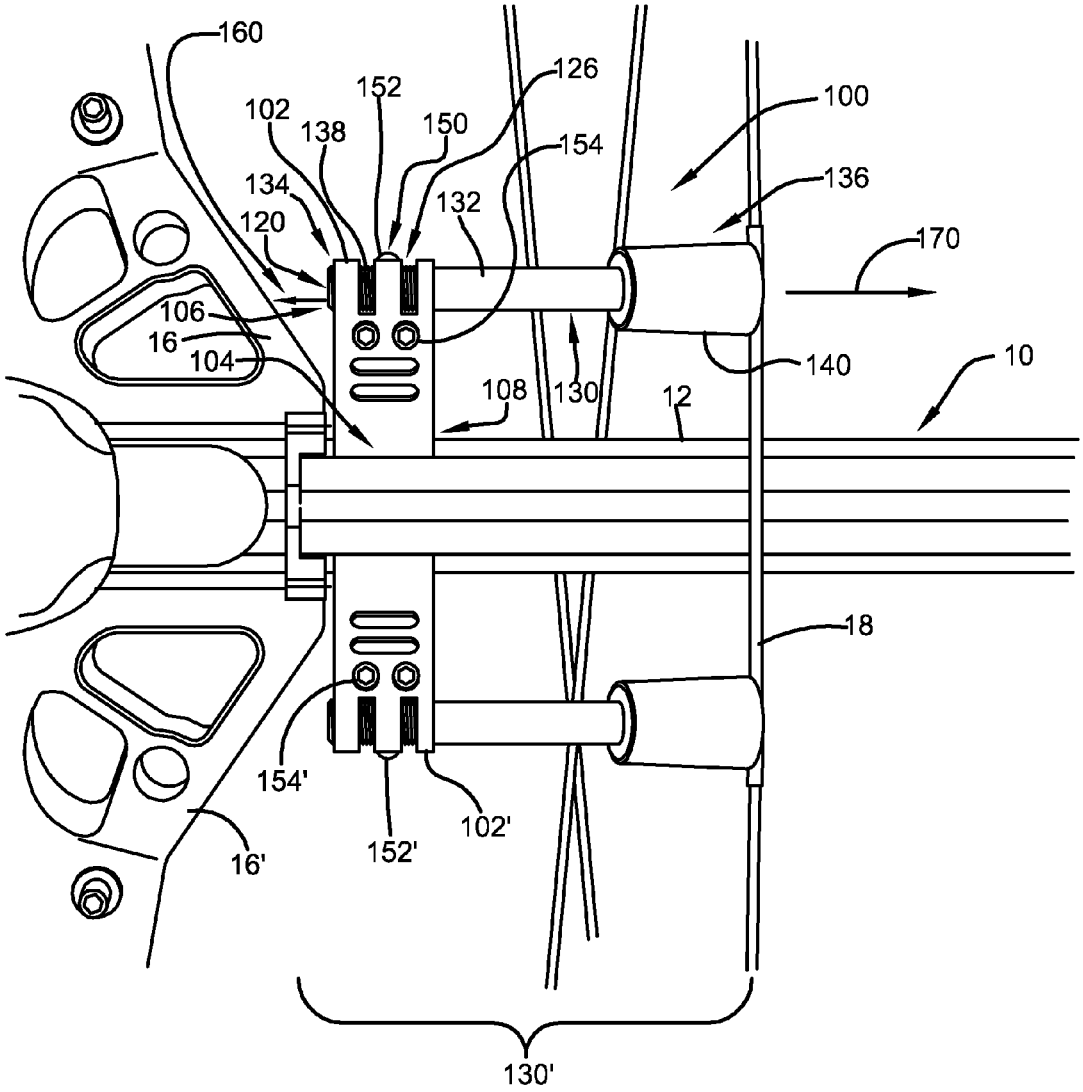
FIG. 1B is a component diagram illustrating a top view of an example implementation of a bow dampener on a crossbow.
Figure 2:
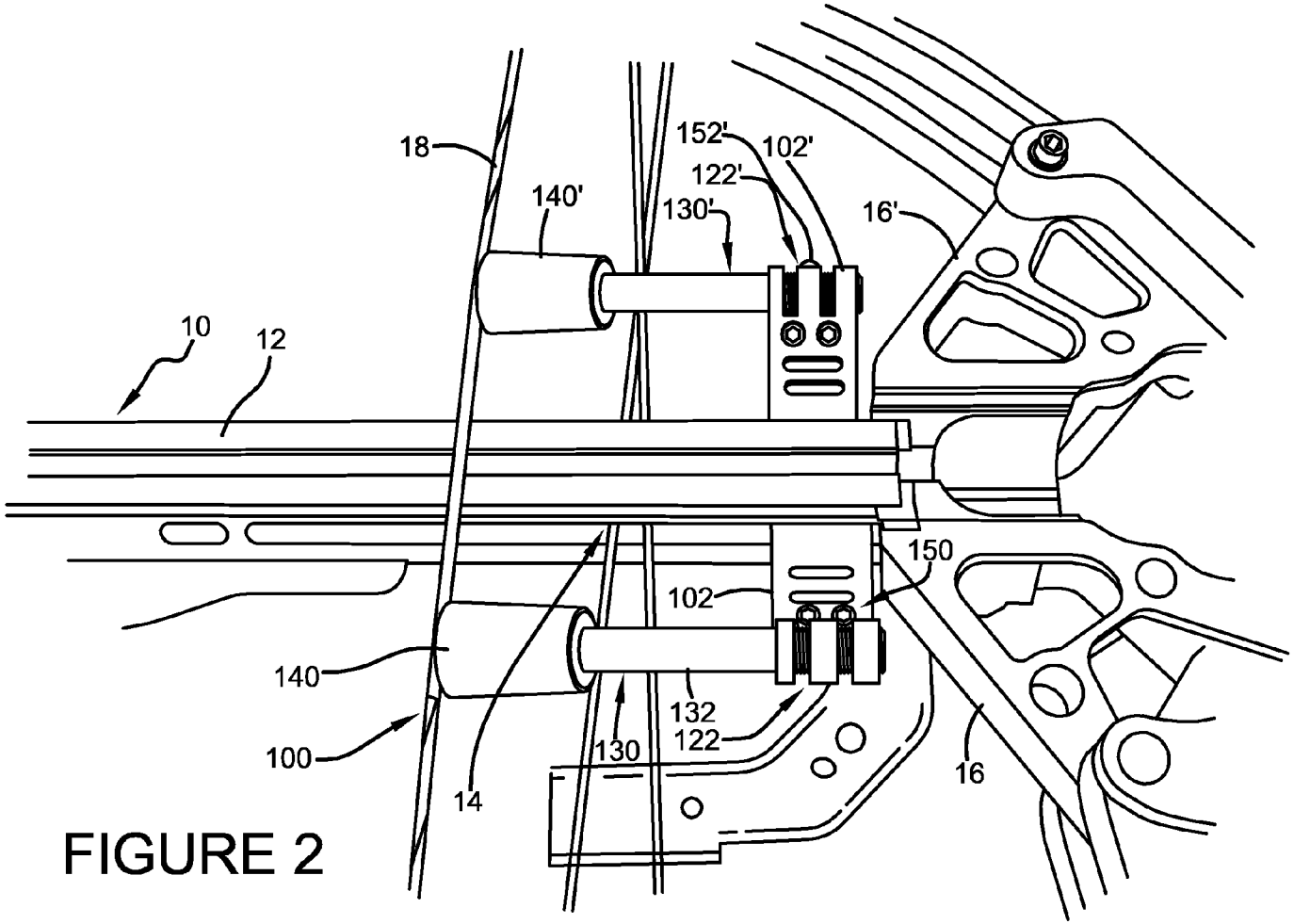
FIG. 2 is a component diagram illustrating a perspective view of an example implementation of a bow dampener on a crossbow.
Figure 3:
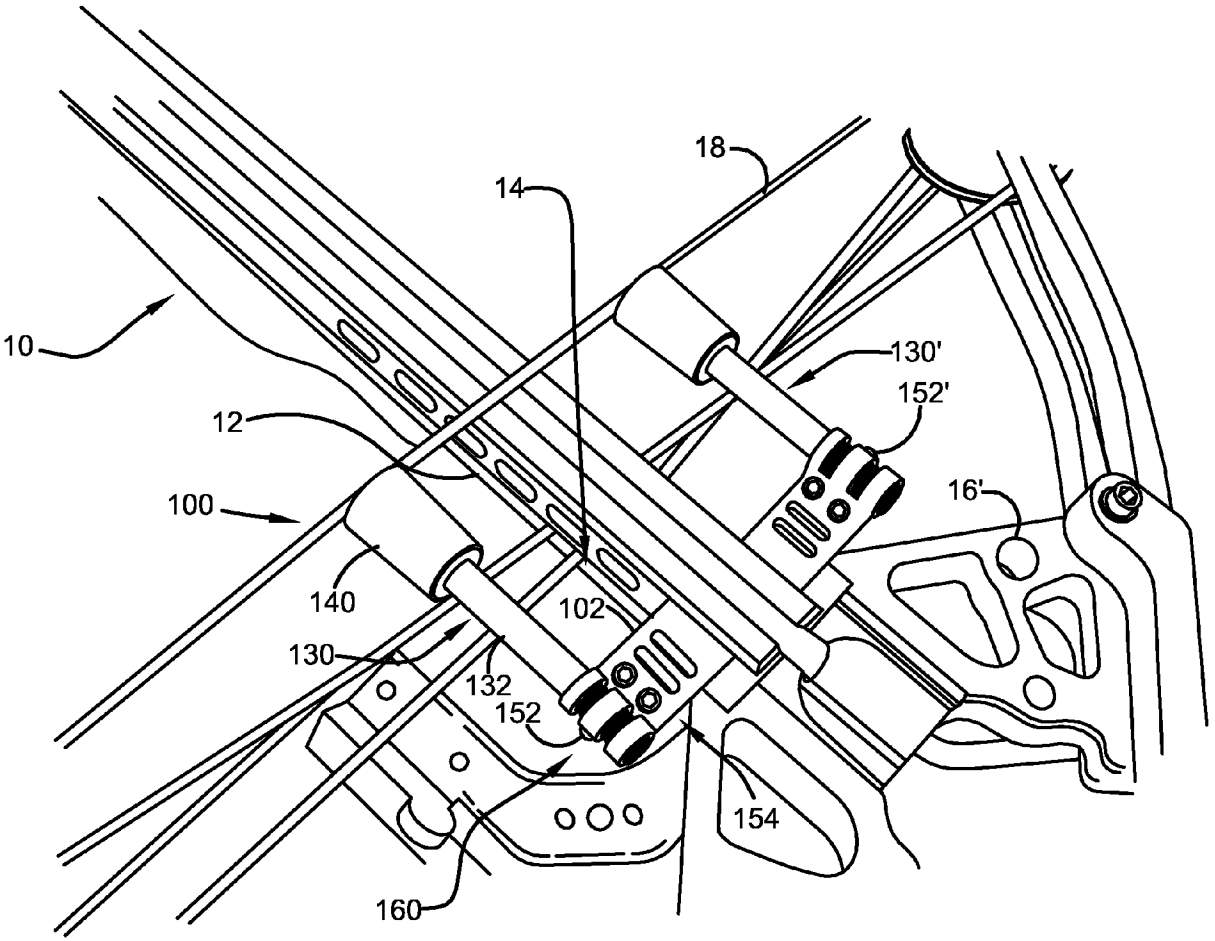
FIG. 3 is a component diagram illustrating a perspective view of an example implementation of a bow dampener on a crossbow.
Figure 4:
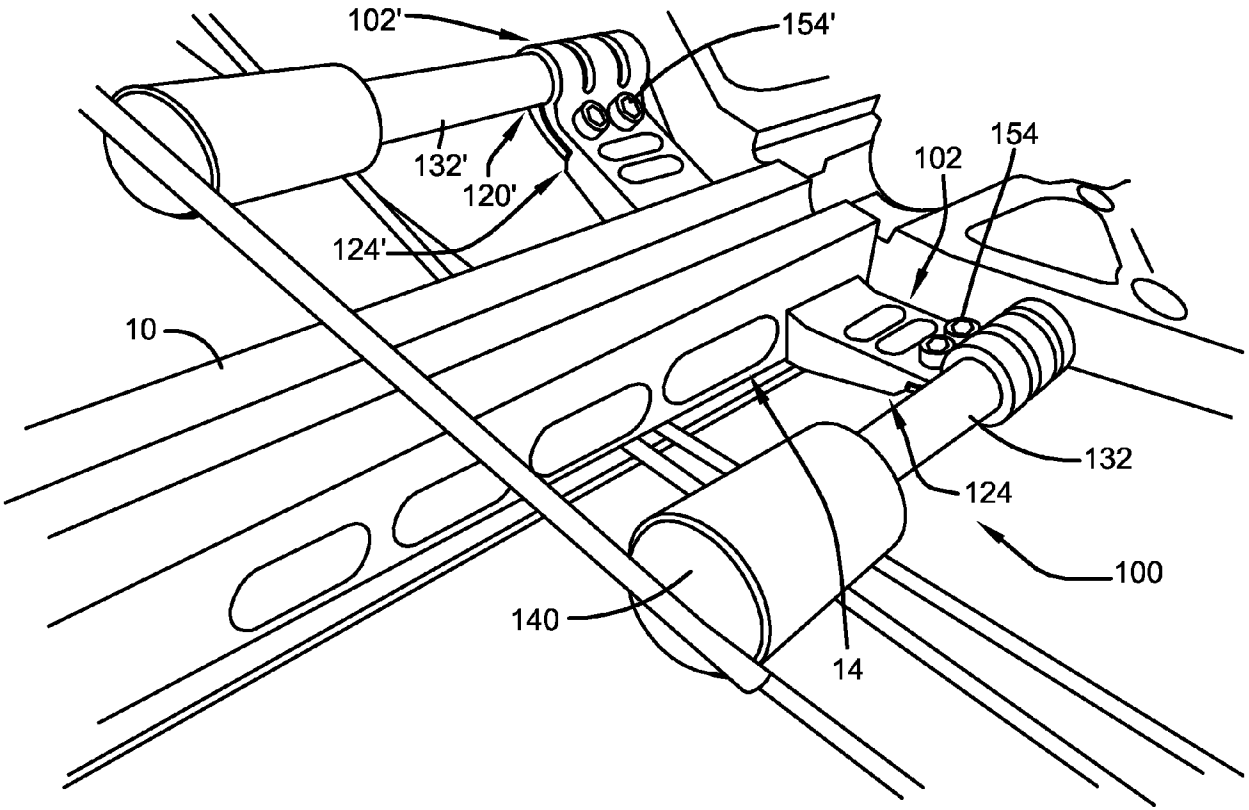
FIG. 4 is a component diagram illustrating a perspective view of an example implementation of a bow dampener on a crossbow.
Figure 5:
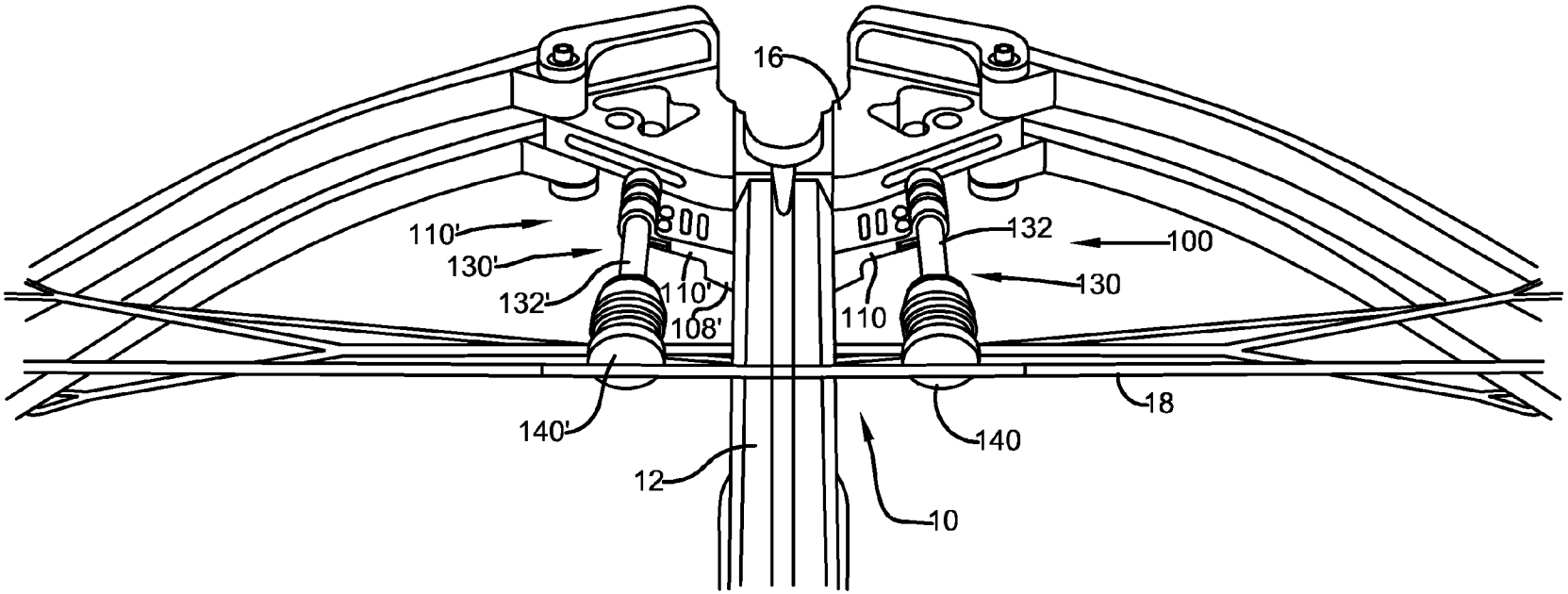
FIG. 5 is a component diagram illustrating a perspective view of an example implementation of a bow dampener on a crossbow.
Figure 6:
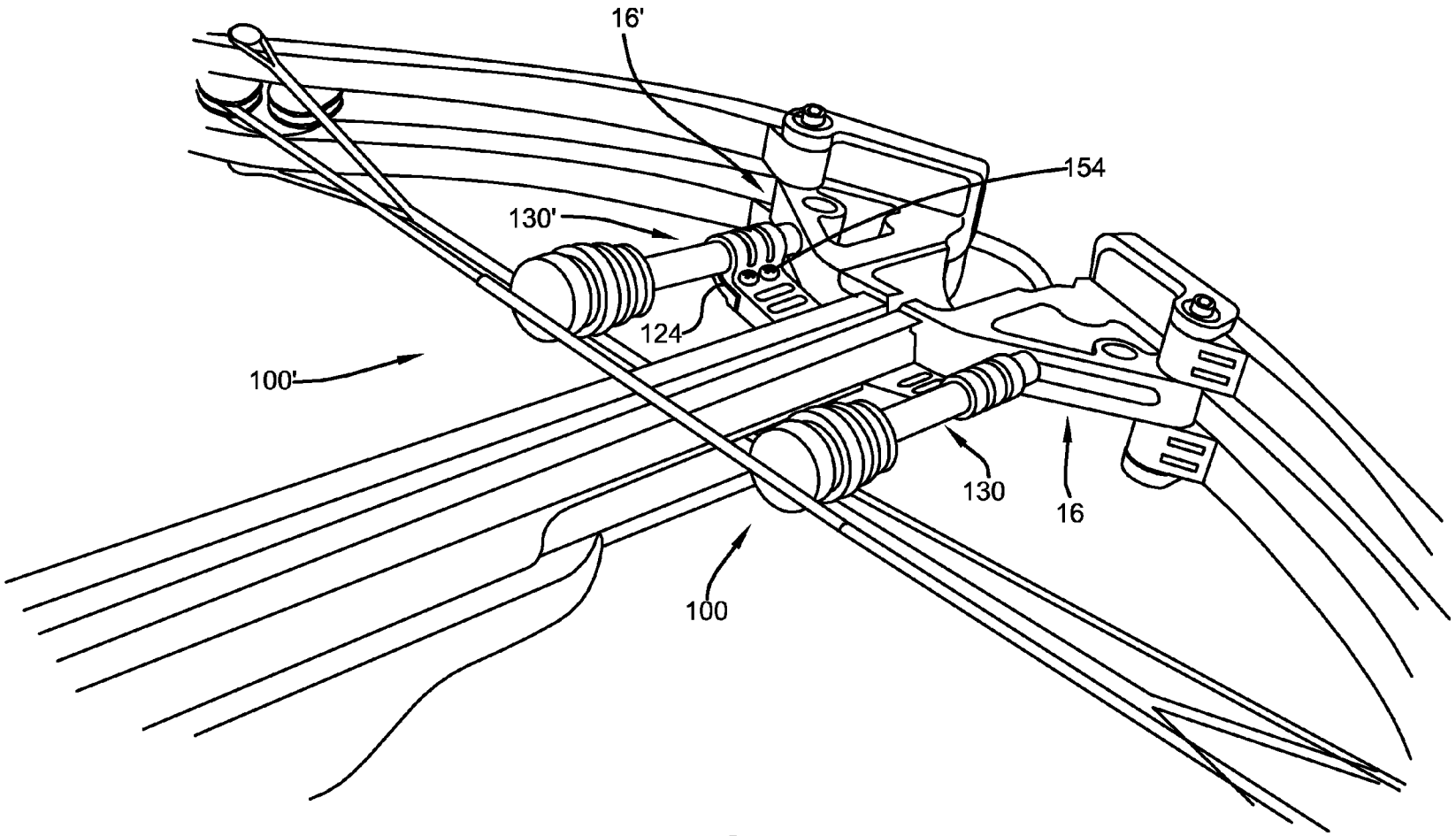
FIG. 6 is a component diagram illustrating a perspective view of an example implementation of a bow dampener on a crossbow.
Figure 7:
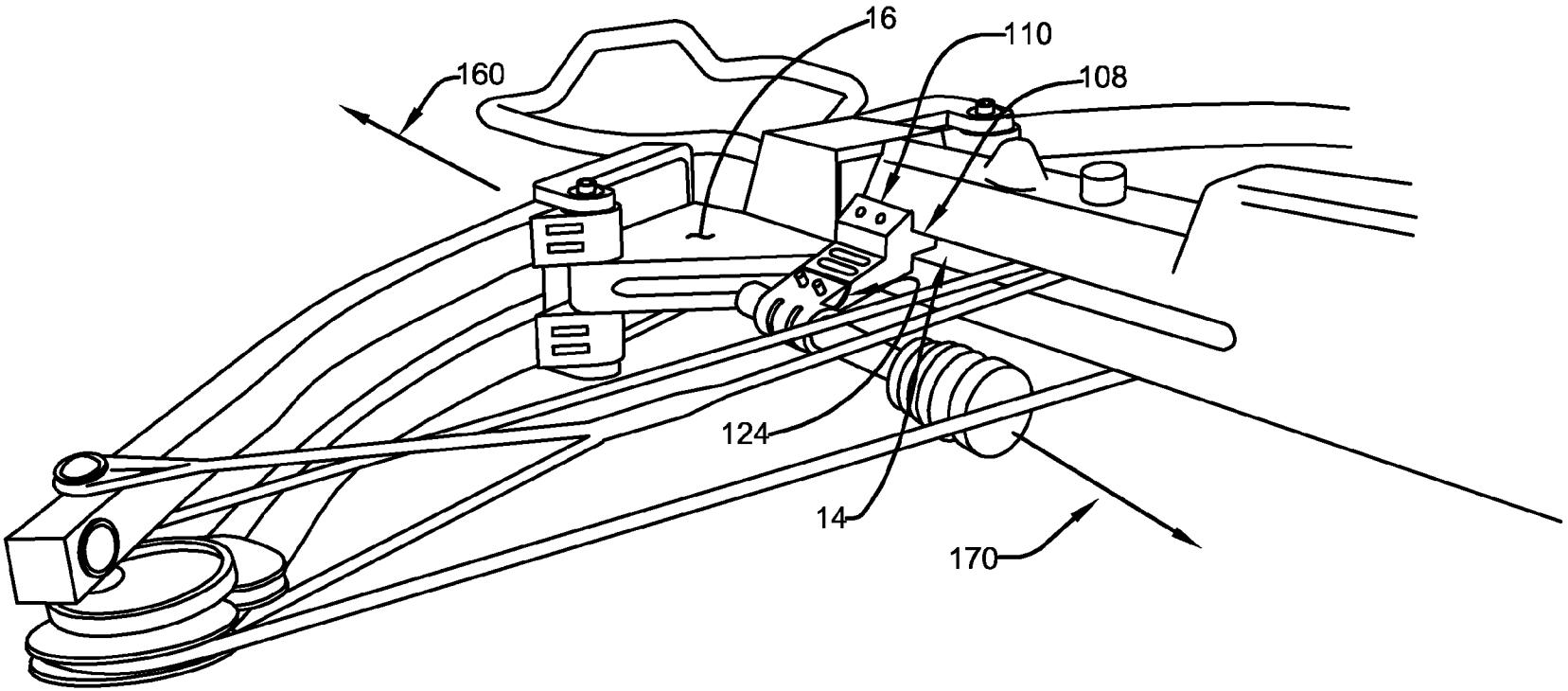
FIG. 7 is a component diagram illustrating a perspective view of an example implementation of a bow dampener on a crossbow.
Figure 8:
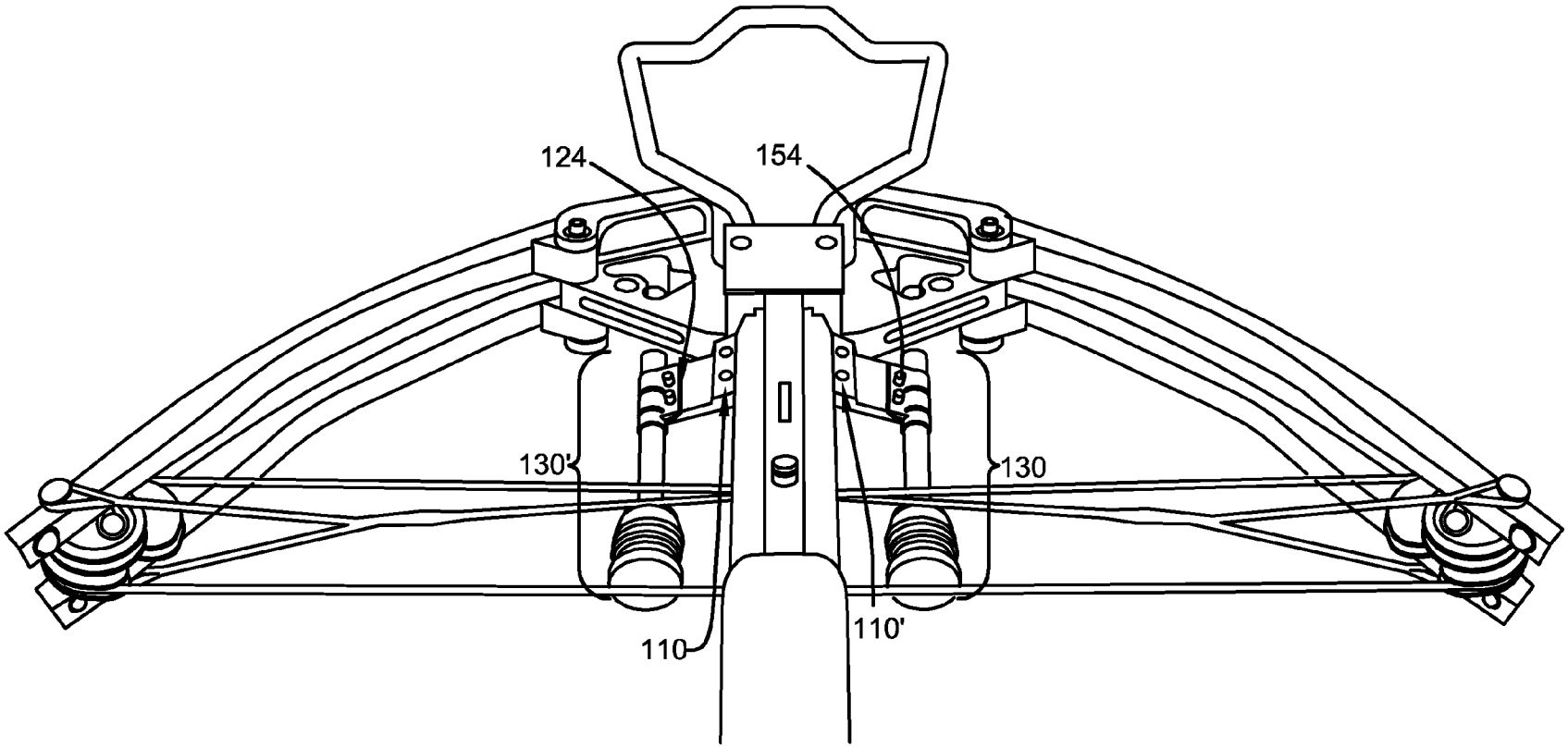
FIG. 8 is a component diagram illustrating a perspective view of an example implementation of a bow dampener on a crossbow.

FIGS. 1A and 1B are component diagrams illustrating a top view of an example implementation of a bow dampener, system and/or apparatus, for a crossbow, with further reference to FIGS. 2-13. In one implementation, a bow dampener 100 comprises a frame element 102 that is configured to support a string dampening element 130. Further, the frame element 102 comprises a barrel mount 108 that is configured to selectively engage a first side of a crossbow barrel 12. As one example, the bow dampener 100 can be mounted on the side of the crossbow barrel 12 using the barrel mount 108, and when the bowstring 18 of the crossbow 10 is released, the bowstring may make contact with the string dampening element 130 supported by the frame element 102, thereby dampening (e.g., mitigating and/or dispersing) energy from the bowstring 18 (e.g., kinetic energy resulting in vibration and/or sound).

In one implementation, the bow dampener 100 can further comprise an elongated support cavity 120 defining an axis of cavity elongation 160. The elongated support cavity 120 can be engaged with a second frame end 106 of the frame element 102, where the frame element also comprises a first frame end 104, which can be engaged with the barrel mount 108. The elongated support cavity 120 can be engaged with a second frame end 106, and/or the barrel mount 108 may be engaged with the first frame end 104 by any suitable means deemed appropriate by good engineering judgment. In one implementation, the elongated support cavity 120 can be engaged to the second frame end 106 by being integrally formed therewith.

Further, in one implementation, the barrel mount 108 may be engaged to the first frame end 104 by being integrally formed therewith.

In one implementation, the elongated support cavity 120 can comprise female threads that are configured to engage at least a portion of the string dampening element 130. The string dampening element 130 can comprise an elongated support shaft 132 that defines an axis of shaft elongation 170. The elongated support shaft 132 can comprise a first shaft end 134 and a second shaft end 136. In one implementation, the first shaft end 134 may be configured to engage the elongated support cavity 120.

In one implementation, the elongated support shaft 132 can comprise male threads 138 that are disposed at least at the first shaft end 134. The elongated support shaft 132 can be configured to be adjustably engaged with the elongated support cavity 120 by threaded engagement of the male threads 138 with female threads 126 disposed in the elongated support cavity 120. The elongated support shaft 132 can define an axis of shaft elongation 170 therealong. As one example, the first shaft end 134, comprising male threads 138 thereon, may be adjustably engaged with elongated support cavity 120 by threaded engagement of the male threads 138 with said female threads 126. In this example, when the elongated support shaft 132 is threadedly engaged with elongated support cavity 120, the axis of shaft elongation 170 may coincide with the axis of cavity elongation 160. The elongated support shaft 132 may be adjustably engaged with elongated support cavity 120, for example, in the sense that the threaded engagement permits an associated user to adjust the position of the elongated support shaft 132 with respect to the elongated support cavity 120 along the axis of cavity elongation 160 by screwing the elongated support shaft 132 further into or further out of the elongated support cavity 120.

Further, in one implementation, the elongated support shaft 132 can comprise a shock tip 140 that may be engaged with the second shaft end 136. The shock tip 140 can comprise any suitable elastomeric material (e.g., configured to dampen string vibration, sound, energy, etc.). As one example, the shock tip 140 comprises an elastomeric material that is configured to absorb and dissipate kinetic energy. For example, the elastomeric material may comprise any material deemed appropriate by good engineering judgment, which, in certain implementations, may comprise a soft and pliable rubber and/or synthetic rubber.

In one implementation, the shock tip 140 may be disposed at or proximate to a position that an associated bow string 18 occupies at an end of an arrow release stroke of the bow string 18, for example, such that the bow string 18 can come in contact with the shock tip 140, thereby transferring some or all of the kinetic energy from the bowstring 18 to the shock tip 140, to be absorbed and dissipated thereby. As one example, a precise positioning of the shock tip 140 may be achieved by careful adjustment of the adjustable components (e.g., elongated support shaft 132 barrel mount 108) of the bow dampener 100 by a user. In some implementations the bow dampener 100 may be useful in mitigating potential damage to the crossbow 10, for example, when a the crossbow is "dry fired," referring to a discharging of the cocked bow string 18 without having an arrow loaded on/in the barrel 12.

With reference to FIGS. 1B-6, in one implementation, the bow dampener 100 may be configured to be selectively engaged with a second side of the crossbow barrel 12 using the barrel mount 108'. That is, for example, the frame element 102 may be achiral or chiral. As used herein "chiral" can refer to an object or system that is not identical to its mirror image. A chiral object cannot be positioned, turned, or rotated to be identical to its mirror image. Chiral is sometimes referred to as "handed-ness," in that the right hand is chiral, and the left hand is chiral. As used herein "achiral" can refer to an object or system that has similar shape and appearance as its mirror image. An achiral object may be able to be positioned, turned or rotated to be similar to its mirror image.

In one implementation, the frame element 102 may be engaged with either side of the crossbow barrel 12 of the crossbow 10, for example, by engaging the barrel mount 108 with the barrel slot 14 accessible from either side of the barrel 12. As one example, as illustrated in the implementations FIGS. 1B-6, a second bow dampener 100' can be engaged with the other side of the crossbow barrel 12, opposite bow dampener 100. In these example implementations, the frame element 102 may be is achiral and frame element 102' may also be achiral. That is, for example, frame element 102 may be rotated to be similar to, and serve a similar function as, frame element 102'. Further, in this example, frame element 102' may be rotated to be similar to, and serve a similar function as, frame element 102.

In these implementations, the frame elements 102, 102' may be selectively engaged with their respective sides of the crossbow barrel 12, using their respective barrel mounts 108, 108', which can be configured to selectively engage with the barrel slot 14 of the crossbow barrel 12. However, the barrel mount 108 may be engaged with the associated crossbow barrel 12 (e.g., any typical crossbow) by any suitable means deemed appropriate by good engineering judgment.

In one implementation, as illustrated in the example implementations of FIGS. 7-9 and 13, the barrel mount 108 can comprise a mount fastening component 110 configured to mitigate movement of said barrel mount 108 with respect to said crossbow barrel. That is, for example, the mount fastening component 110 can facilitate the selective mounting of the frame element 102 to that crossbow barrel 12, such that the frame element 102 can hold the string dampening element 130 in an appropriate position for use in dampening the bowstring 18 vibrations, without moving.

Figure 9:
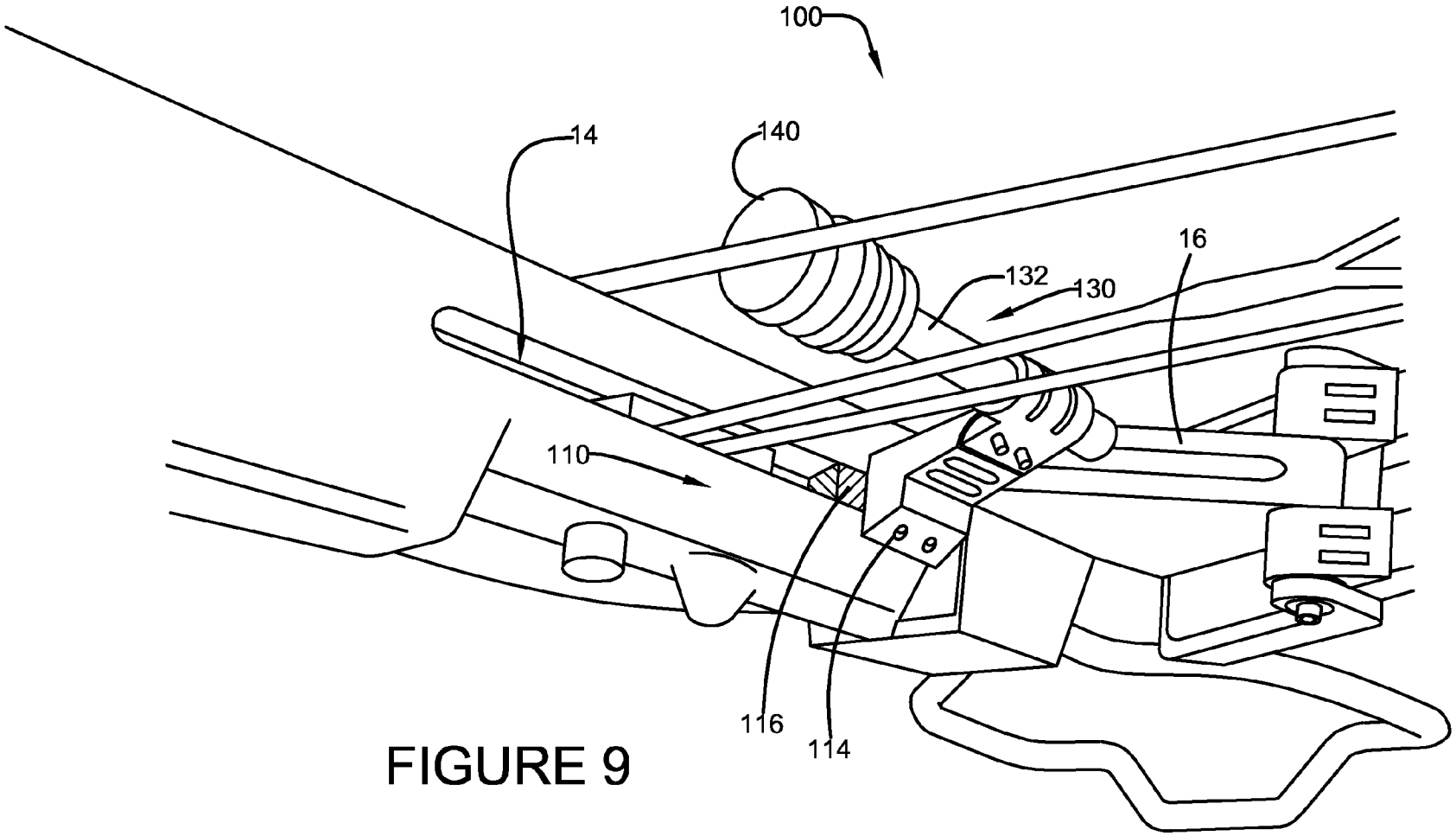
FIG. 9 is a component diagram illustrating a perspective view of an example implementation of a bow dampener on a crossbow.
Figure 10:
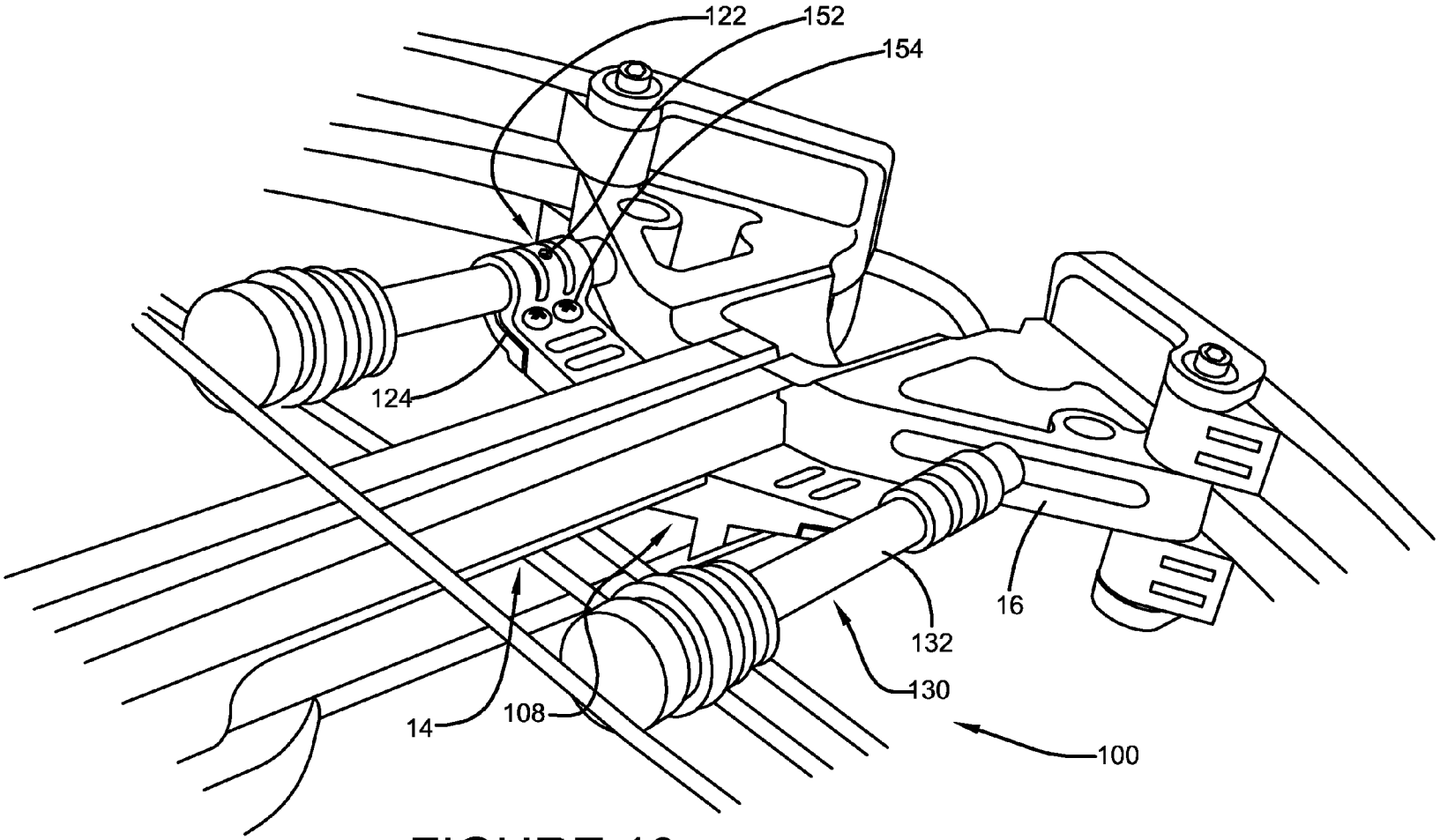
FIG. 10 is a component diagram illustrating a perspective view of an example implementation of a bow dampener on a crossbow.
Figure 11:
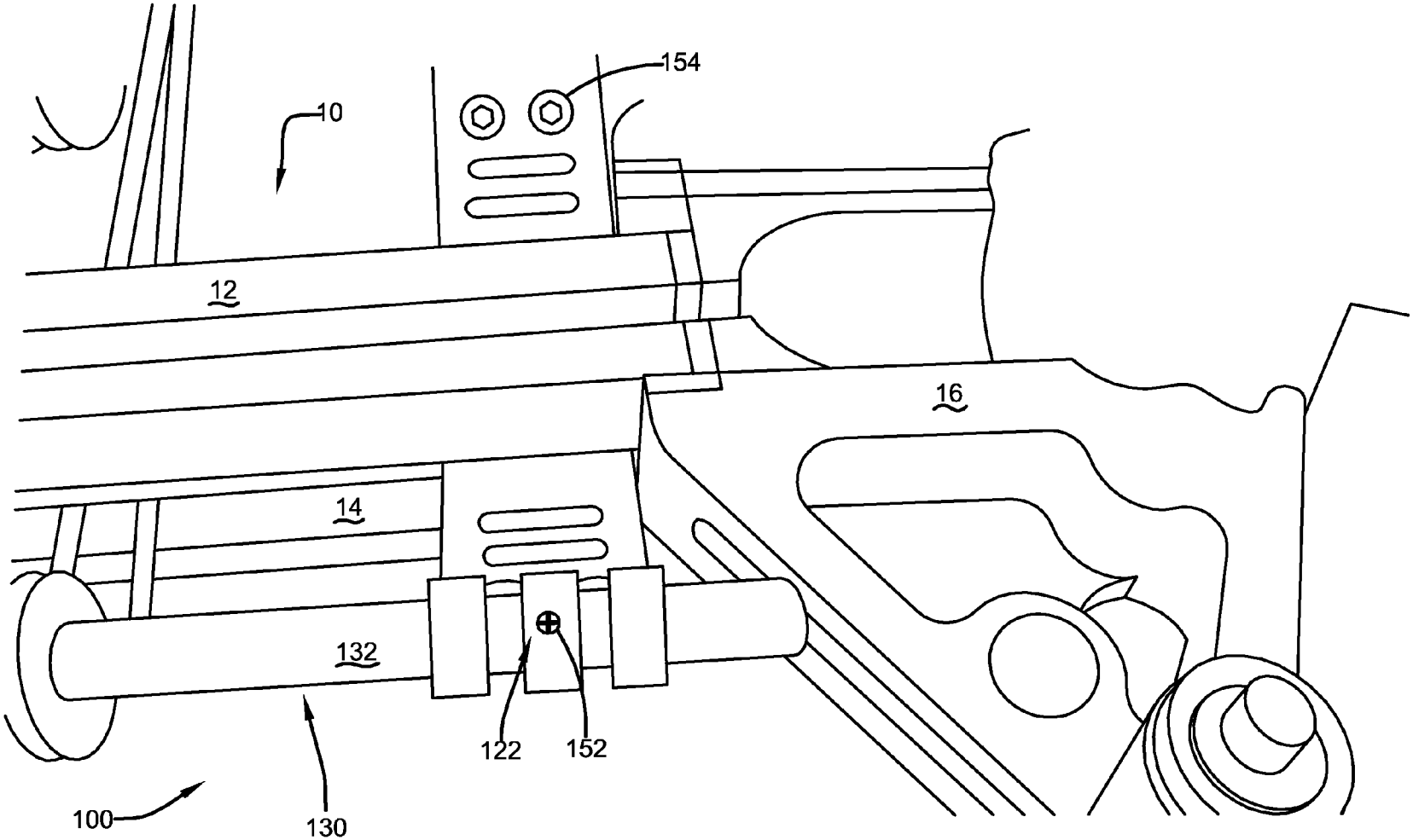
FIG. 11 is a component diagram illustrating a perspective view of an example implementation of a bow dampener on a crossbow.
Figure 12:
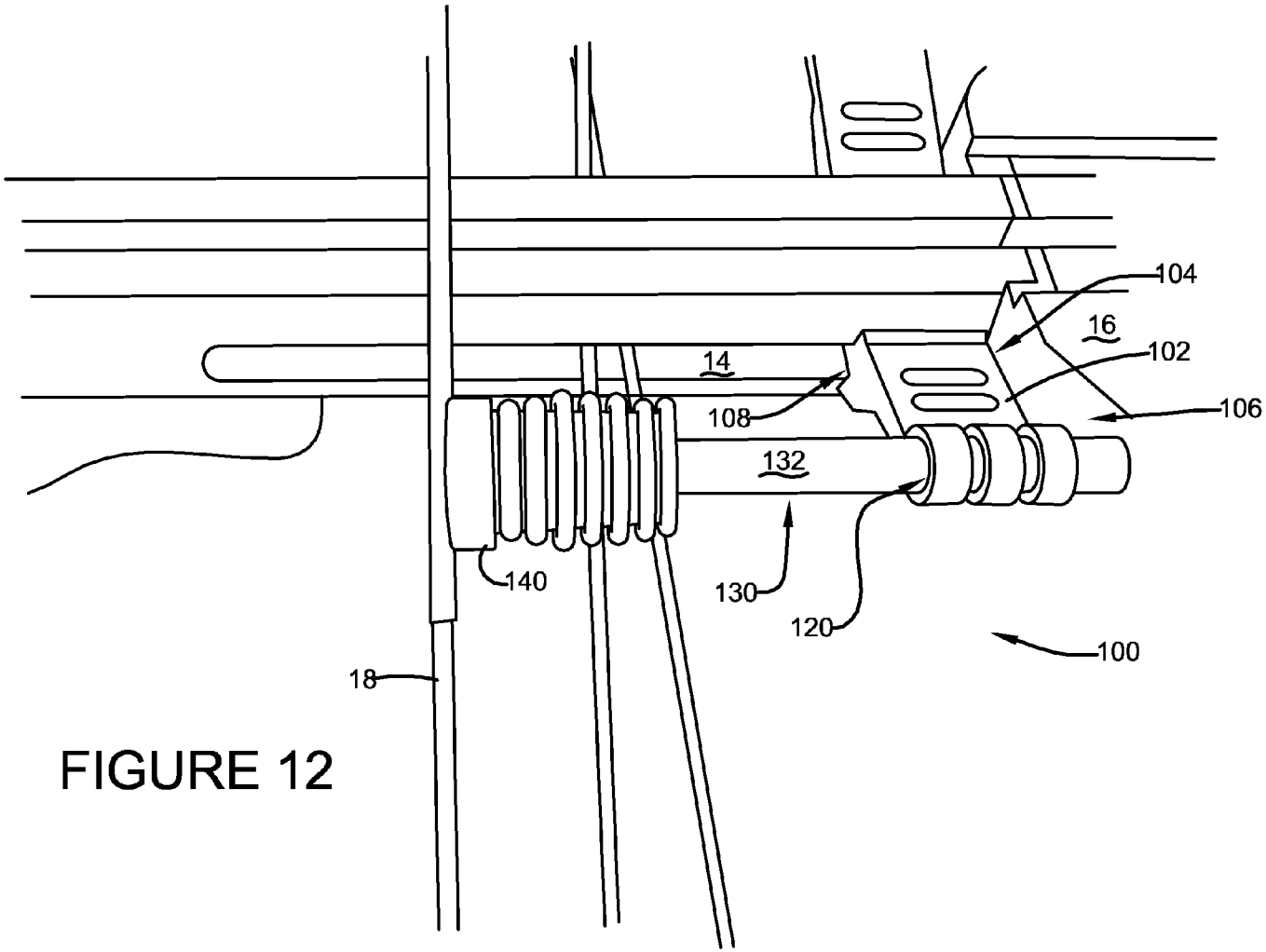
FIG. 12 is a component diagram illustrating a perspective view of an example implementation of a bow dampener on a crossbow.
Figure 13:
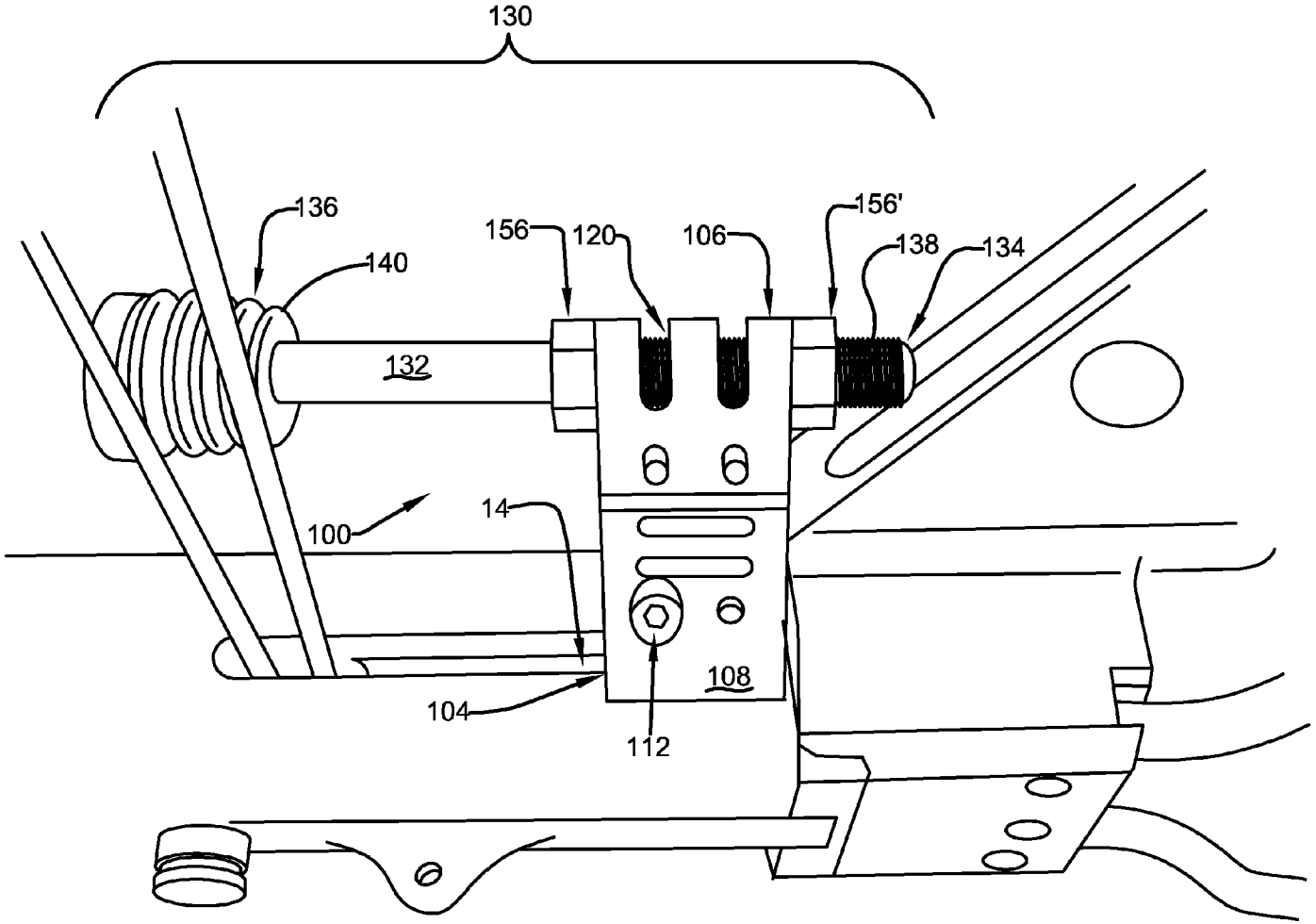
FIG. 13 is a component diagram illustrating a perspective view of an example implementation of a bow dampener on a crossbow.

In one implementation, the mount fastening component 110 can comprise a fastening means, such as a clamping fastener 112 as illustrated in FIG. 13; a set screw 114 as illustrated in FIG. 9; and/or a slide stop 116 as illustrated in FIG. 9. As an example, a clamping fastener 112 may comprise an opening engaged with at least a portion of the side of the crossbow barrel 12, where a size of the opening is controlled by a clamping screw 154 that can be adjusted to close the opening (e.g., clamp onto) the side of the barrel 12. As another example, a set screw 114 may be inserted into an opening in the mount fastening component 110, where the set screw 114 can be adjusted to engage with (e.g., be forced against) a portion of the side of the barrel 12, such that the barrel mount 108 is thereby held in place on the barrel 12. As another example, one or more slide stops may be positioned adjacent to the barrel mount 108 and secured against the side of the barrel 12 (e.g., by another fastening means), such that the slide stop(s) 116 mitigates movement of the barrel mount 108 laterally along the side of the barrel 12.

As illustrated in FIGS. 1-4 and 8-13, the elongated support cavity 120 of the bow dampener 100 may optionally comprise a shaft fastening component 150, which can be configured to mitigate movement of the string dampening element 130 with respect to the elongated support cavity 120. In one implementation, the shaft fastening component 150 may comprise a shaft fastening means, such as a clamping screw 154, a set screw 152, and/or a set nut 156.

In some implementations, as illustrated in FIGS. 1-4, 6-8, and 10, the elongated support cavity 120, 120' may comprise an open seam 124, 124' that may be configured to permit the elongated support cavity 120, 120' to vary (slightly) in size, thereby allowing a tightness of fit, with respect to the engagement of the elongated support shaft 132, 132' therewith, to vary. In one implementation, a variation in the size of the open seam 124, 124' may be adjusted by a clamping screw 154, 154' that can be configured to span the open seam 124, 124'. In implementations comprising an open seam 124, 124' spanned by a clamping screw 154, 154', for example, a user may adjust the clamping screw 154, 154' to widen the open seam 124, 124', thereby loosening the fit of the elongated support shaft 132, 132' with respect to the elongated support cavity 120, 120' and thereby making adjustment of the elongated support shaft 132, 132' with respect to the elongated support cavity 120, 120' easier. In implementations comprising an open seam 124, 124' spanned by a clamping screw 154, 154', for example, the user may adjust the clamping screw 154, 154' to restrict the open seam 124, 124', thereby tightening the fit of the elongated support shaft 132, 132' with respect to the elongated support cavity 120, 120' and thereby make adjustment of the elongated support shaft 132, 132' with respect to the elongated support cavity 120, 120' difficult or clamped into place.

In some implementations, as illustrated in FIGS. 1-4, 10, and 11, the elongated support cavity 120 may comprise an aperture 122, 122' that can be configured to accept a set screw 152, 152'. In some implementations, the aperture 122, 122' can comprise female threads that are configured to engage male threads of an adjustable set screw 152, 152', such that an associated user may adjust the degree to which the set screw 152, 152' protrudes into elongated support cavity 120, 120'. For example, the adjustment may be made by threading the set screw 152, 152' into or out of the elongated support cavity 120, 120' (e.g., using an appropriate tool, such as a screwdriver, hex-wrench, etc.).

As one example, a degree to which the set screw 152, 152' may protrude into the elongated support cavity 120, 120' can affect an adjustability of a position of the elongated support shaft 132, 132' with respect to the elongated support cavity 120, 120'. In implementations comprising a set screw 152, 152', a user may adjust the set screw 152, 152', causing it to protrude into the elongated support cavity 120, 120', thereby contacting or engaging the elongated support shaft 132, 132', and thereby making adjustment of the elongated support shaft 132, 132' with respect to the elongated support cavity 120, 120' difficult or even effectively set in place. Further, the user may adjust set screw 152, 152' to cause it to retreat from the elongated support cavity 120, 120', thereby disengaging the elongated support shaft 132, 132', and thereby allowing an adjustment of the elongated support shaft 132, 132' with respect to the elongated support cavity 120, 120' to be made.

In one implementation, as illustrated in FIG. 13, one or more set nuts 156 may be threadedly engaged with the male threads 138 of the elongated support shaft 132. In one implementation, a first set nut 156 may be disposed on the elongated support shaft 132 at a first side of the elongated support cavity 120 (e.g., toward the second shaft end 136 the elongated support shaft 132), and a second set nut 156' may be disposed on the elongated support shaft 132 at a second side of the elongated support cavity 120 (e.g., toward the first shaft end 134 of the elongated support shaft 132). As one example, one or more set nuts 156 can be tightened (e.g., using the male threads 138) against the side(s) of the elongated support cavity 120, effectively setting the elongated support shaft 132 in place with respect to the elongated support cavity 120. As another example, the one or more set nuts 156 can be loosened from the side(s) of the elongated support cavity 120, effectively loosening the elongated support shaft 132 with respect to the elongated support cavity 120, thereby allowing adjustment of the elongated support shaft 132 with respect to the elongated support cavity 120.

In some implementations, as illustrated in the example implementations of FIGS. 5-13 the bow dampener 100, 100' may be installed in a position on the barrel 12 of the crossbow 10, such that the axis of shaft elongation 170 intersects a riser 16 of the crossbow 10. In such implementations, the elongated support shaft 132, 132' may be positioned to directly or indirectly contact the riser 16. That is, for example, the elongated support shaft 132 may be adjusted with respect to the elongated support cavity 120 (e.g., by threading the shaft 132 into the cavity 120), such that the first end of the elongated support shaft 132 comes in contact with the riser 16. As another example, the barrel mount 108 may be engaged with the side of the crossbow barrel 12 in such a location as to allow the first end of the elongated support shaft 132 to come in contact with (e.g., or not) the riser 16.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited merely by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to merely one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A bow dampener, comprising:

a frame element configured to support a string dampening element, said frame element comprising a barrel mount configured to selectively engage a first side of a crossbow barrel; and, wherein said barrel mount is further configured to selectively engage with a barrel slot of said crossbow barrel.

2. The bow dampener of claim 1, wherein said barrel mount comprises a mount fastening component configured to mitigate movement of said barrel mount with respect to said crossbow barrel.

3. The bow dampener of claim 2, wherein said mount fastening component comprises a mount fastening means, said mount fastening means comprising one or more of:

a clamping fastener;

a set screw; and slide stop.

4. The bow dampener of claim 1, wherein said barrel mount is further configured to selectively engage with a second side of said crossbow barrel.

5. The bow dampener of claim 1, further comprising an elongated support cavity defining an axis of cavity elongation, said elongated support cavity engaged with a second frame end of said frame element, wherein said frame element comprises a first frame end engaged with said barrel mount.

6. The bow dampener of claim 5, wherein said elongated support cavity comprises female threads configured to engage at least a portion of said string dampening element.

7. The bow dampener of claim 5, wherein said string dampening element comprises an elongated support shaft defining an axis of shaft elongation and comprising a first shaft end and a second shaft end, said first shaft end configured to engage said elongated support cavity.

8. The bow dampener of claim 7, wherein said elongated support shaft comprises male threads disposed at least at said first shaft end, said elongated support shaft configured to be adjustably engaged with said elongated support cavity by threaded engagement of said male threads with female threads disposed in said elongated support cavity.

9. The bow dampener of claim 7, wherein said elongated support shaft comprises a shock tip engaged with said second shaft end, said shock tip comprising an elastomeric material.

10. The bow dampener of claim 5, wherein said elongated support cavity further comprises a shaft fastening component configured to mitigate movement of said string dampening element with respect to said elongated support cavity.

11. The bow dampener of claim 10, wherein said shaft fastening component comprises a shaft fastening means, said shaft fastening means comprising one or more of:

a clamping screw;

a set screw; and set nut.

12. A bow dampener comprising:

a string dampening element;

a frame element that: (1) comprises a support cavity that supports said string dampening element; (2) is configured to selectively engage a crossbow; (3) comprises a seam that communicates with said support cavity; and, (4) comprises a clamping fastener that is adjustable to vary the size of said seam and thereby said support cavity; and, wherein at least one of:

(A) said clamping fastener comprises first and second clamping screws; and, (B) said frame element comprises an aperture that communicates with said support cavity; and, a set screw is adjustable within said aperture to selectively contact said string dampening element.

13. A bow dampener comprising:

a string dampening element;

a frame element that: (1) comprises a support cavity that supports said string dampening element; (2) is configured to selectively engage a crossbow; (3) comprises a seam that communicates with said support cavity; and, (4) comprises a clamping fastener that is adjustable to vary the size of said seam and thereby said support cavity; and, wherein at least one of:

(A) said string dampening element comprises: an elongated support shaft that is received in said support cavity; and, a shock tip comprising elastomeric material;

(B) said string dampening element comprises male threads; said support cavity comprises female threads configured to engage said male threads; and, said string dampening element is adjustably engaged with said support cavity by threaded engagement of said male threads with said female threads; and, (C) said string dampening element is configured to be adjusted to be in direct contact with a riser of said crossbow.

14. The bow dampener of claim 13 wherein said string dampening element comprises:

an elongated support shaft that is received in said support cavity; and, a shock tip comprising elastomeric material.

15. The bow dampener of claim 13 wherein:

said string dampening element comprises male threads;

said support cavity comprises female threads configured to engage said male threads; and, said string dampening element is adjustably engaged with said support cavity by threaded engagement of said male threads with said female threads.

16. The bow dampener of claim 15 further comprising at least one nut that:

threadingly engages said male threads; and, is adjustable to limit the adjustability of said string dampening element within said support cavity.

17. The bow dampener of claim 13 wherein:

said string dampening element is configured to be adjusted to be in direct contact with a riser of said crossbow.

18. The bow dampener of claim 13 wherein:

said frame element comprises a barrel mount configured to selectively engage a barrel of said crossbow.

* * * * *